US007001202B2

(12) United States Patent
Robbins

(10) Patent No.: US 7,001,202 B2
(45) Date of Patent: Feb. 21, 2006

(54) REUSABLE POWER CORD RETAINING DEVICE

(76) Inventor: Thomas E. Robbins, 3 Neil Dr., Smithtown, NY (US) 11787

( * ) Notice: Subject to any disclaimer, the term of this patent is extended or adjusted under 35 U.S.C. 154(b) by 0 days.

(21) Appl. No.: 10/966,204

(22) Filed: Oct. 15, 2004

(65) Prior Publication Data

US 2005/0085118 A1 Apr. 21, 2005

Related U.S. Application Data

(60) Provisional application No. 60/512,346, filed on Oct. 17, 2003.

(51) Int. Cl.
*H01R 13/62* (2006.01)

(52) U.S. Cl. ..... 439/369; 439/367

(58) Field of Classification Search ..... 439/367–369, 439/370, 359–366
See application file for complete search history.

(56) References Cited

U.S. PATENT DOCUMENTS

| | | | | | |
|---|---|---|---|---|---|
| 3,030,601 | A | * | 4/1962 | Krebs | 439/369 |
| 3,209,061 | A | * | 9/1965 | Mier et al. | 174/5 R |
| 4,143,934 | A | * | 3/1979 | Siebert | 439/369 |
| 4,169,643 | A | | 10/1979 | Gallagher | 339/75 P |
| 4,329,987 | A | * | 5/1982 | Rogers et al. | 604/533 |
| 4,643,505 | A | * | 2/1987 | House et al. | 439/369 |
| 4,736,999 | A | * | 4/1988 | Marks et al. | 439/314 |
| 4,749,363 | A | | 6/1988 | Luska et al. | 439/367 |
| 4,784,612 | A | * | 11/1988 | Ryan | 439/367 |
| 4,869,683 | A | | 9/1989 | Nelson | 439/369 |
| 4,925,399 | A | * | 5/1990 | Bosworth et al. | 439/370 |
| 4,927,377 | A | | 5/1990 | Bach et al. | 439/367 |
| 4,940,424 | A | * | 7/1990 | Odbert | 439/369 |
| 4,998,891 | A | * | 3/1991 | Bresko | 439/369 |
| 5,037,324 | A | | 8/1991 | Scheffey, Sr. | 439/452 |
| 5,110,303 | A | | 5/1992 | Hardy | 439/367 |
| 5,129,839 | A | | 7/1992 | VanSkiver | 439/367 |
| 5,135,409 | A | | 8/1992 | Thompson | 439/367 |
| 5,147,216 | A | | 9/1992 | Shotey | 439/367 |
| 5,211,573 | A | * | 5/1993 | Cross | 439/369 |
| 5,217,387 | A | | 6/1993 | Hull et al. | 439/367 |
| 5,259,782 | A | * | 11/1993 | Giffin | 439/367 |
| 5,299,951 | A | | 4/1994 | Blaetz | 439/367 |
| 5,306,176 | A | * | 4/1994 | Coffey | 439/367 |
| 5,443,397 | A | * | 8/1995 | Carl | 439/369 |
| 5,505,634 | A | | 4/1996 | Osten | 439/369 |
| 5,616,046 | A | | 4/1997 | Sundstrom et al. | 439/367 |
| 5,755,588 | A | * | 5/1998 | Sweatman et al. | 439/369 |

(Continued)

*Primary Examiner*—Ross Gushi
*Assistant Examiner*—Larisa Tsukerman
(74) *Attorney, Agent, or Firm*—Gerald T. Bodner

(57) ABSTRACT

A retaining device retains a pair of electrical power cords, one cord having a plug which is joined to a socket of the other cord. The device has first and second receptacles, each with a first open end and a second open end, and an opening extending from the first open end to the second open end. The first open end, the second open end, and the opening extending from the first open end to the second open end of the first and second receptacles together form a space for receiving the ends of the power cords, including the plug and socket. The first receptacle inserts into the second receptacle to adjust the overall length of the retaining device and locks in place to retain the ends of the pair of power cords and the plug and socket coupled to each other. The first receptacle is turned to release it from the second receptacle in order to remove the coupled ends of the power cords.

2 Claims, 21 Drawing Sheets

U.S. PATENT DOCUMENTS

| | | | | |
|---|---|---|---|---|
| 5,762,515 | A | 6/1998 | Mele | 439/367 |
| 5,772,462 | A * | 6/1998 | Osten | 439/367 |
| 5,782,649 | A | 7/1998 | Aiken | 439/369 |
| 5,813,879 | A * | 9/1998 | Russo | 439/367 |
| 5,881,912 | A * | 3/1999 | Bokros | 222/1 |
| 5,913,692 | A | 6/1999 | Targett | 439/369 |
| 6,036,525 | A | 3/2000 | Alfis, III | 439/367 |
| 6,056,580 | A * | 5/2000 | Cross et al. | 439/369 |
| 6,099,340 | A | 8/2000 | Florentine | 439/367 |
| 6,171,132 | B1 | 1/2001 | Schmidt | 439/369 |
| 6,217,366 | B1 | 4/2001 | Weisstock | 439/369 |
| 6,234,823 | B1 * | 5/2001 | Fuess | 439/346 |
| 6,250,946 | B1 | 6/2001 | Tardy | 439/367 |
| 6,409,534 | B1 | 6/2002 | Weisz-Margulescu | 439/367 |
| 6,454,576 | B1 * | 9/2002 | Hedrick et al. | 439/105 |
| 6,478,601 | B1 * | 11/2002 | Oswald | 439/369 |
| 6,602,087 | B1 | 8/2003 | Carle | 439/369 |
| 6,878,007 | B1 * | 4/2005 | Decker | 439/369 |
| 2002/0024217 | A1 * | 2/2002 | Mummert | 285/187 |

* cited by examiner

REUSABLE POWER CORD RETAINING DEVICE

CROSS-REFERENCE TO RELATED APPLICATIONS

This application claims the benefit of priority under 35 U.S.C. §119 of U.S. Provisional Patent Application No. 60/512,346 filed on Oct. 17, 2003, entitled "Reusable Power Tool Cord Locking Device", and which is incorporated herein by reference in its entirety.

BACKGROUND OF THE INVENTION

The present invention relates generally to the field of tools and particularly to a retaining or locking device for ensuring maintenance of a connection between a plug and a receptacle of an electrical extension cord.

DESCRIPTION OF THE PRIOR ART

Electrically powered tools are often employed in locations that are too distant from a wall outlet to allow for connection to the power line without use of an extension cord. In normal use, the prongs of the power tool plug are inserted into the slots of an extension cord socket receptacle and the friction associated with this mating is relied upon to maintain satisfactory electrical connection. Unfortunately, movement of the tool in its routine excursions about the work site can apply tension forces to the mated plug and socket such that they become unexpectedly disconnected. Experienced trades personnel encounter this difficulty so frequently that many have adopted the practice of first tying a knot with the two power cords before mating the plug and socket. This is illustrated in FIG. 1 where cord 28 has a coupler or plug 50 which is connected to a coupler or socket 50, which in turn is connected to cord 27. Prior to joining plug 50 to socket 40, a knot 60 is formed. This arrangement succeeds in avoidance of disconnection but, as illustrated in FIG. 2, presents other difficulties associated with the large knot/loop 60 becoming snagged on objects 70 and leads to premature fatigue damage to the power and extension cords caused by frequent knotting with tight bend radii.

Certain other disclosed cord coupling devices already available cannot be easily removed from the power cords once installed such that it is necessary to purchase and install multiple devices in order to treat power cords of multiple tools. By way of example, FIGS. 3A, 3B and 3C show a locking sleeve device 80 of the prior art consisting of two portions 82 and 84 that requires that the plug 50 and socket 40 be pushed through a one-way opening 86, 88 in the end of each portion 82, 84 before mating. These parts 80, 82, 84, 40 and 50 are subsequently very difficult to remove intact from their respective cords 27 and 28 and each new power tool needs to be equipped with its own locking sleeve.

OBJECTS AND SUMMARY OF THE INVENTION

It is an object of the invention to provide a retaining device for coupling together two electrical cables which does not require that the wires from plug or socket portions of the cables be removed.

It is another object of the invention to provide a retaining device for coupling together two electrical cables which enables rapid manual operation of the device without need for any other tools such as screwdriver or pliers.

It is still another object of this invention to provide a retaining device which does not require any additional separate components to be inserted or applied such as auxiliary clips, elastic bands, internal locking disks or other such loose pieces.

It is yet another object of the invention to provide a single complete assembly retaining device for coupling together two electrical cables that remains a joined unit which is inhibited from becoming inadvertently disassembled when not in use.

It is still another object of the invention to provide a retaining device that is easily removed from the mated plug/socket pair of the coupled cables and can be readily transferred to another plug/socket pair of different size and geometry.

The present invention is directed to a retaining device for retaining in a joined position a pair of electrical cables, such as two extension cords or an extension cord and the power cord of an electrical tool (hereinafter both referred to generally as power cords). An end of at least one of the pair of power cords has a first coupler for removably coupling to a second coupler at an end of the other power cord. The retaining device includes a first receptacle having a first open end and a second open end, a motion limiting member disposed therebetween for limiting motion of one of the first coupler and the second coupler, and an opening extending from the first open end to the second open end which passes through the motion limiting member of the first receptacle; and a second receptacle having a first open end and a second open end, a motion limiting member disposed therebetween for limiting motion of the other of the first coupler and the second coupler, and an opening extending from the first open end to the second open end which passes through the motion limiting member of the second receptacle. The first open end, the second open end, and the opening extending from the first open end to the second open end of each of the first and second receptacles together form a space for receiving portions of the power cords and the first coupler and the second coupler. The first receptacle and the second receptacle are removably joinable with respect to each other for thereby retaining the first coupler of one of the power cords in a coupled position with the second coupler of the other power cord.

The first coupler can be a plug, and the second coupler can be a socket. Conversely, the first coupler can be a socket, and the second coupler can be a plug. The first receptacle can be comprised of one of a (a) male inner portion and (b) a female outer portion, and wherein the second receptacle is comprised of the other one of a (a) male inner portion and (b) a female outer portion. The male inner portion is removably joined to the female outer portion such that the interior space defined by the first receptacle and the second receptacle can be varied in length to receive and hold securely together the first and second couplers of the two power cords.

The retaining device can further be formed such that one of the (a) first receptacle and (b) second receptacle has formed in it a plurality of slots in a linear arrangement, and the other one of the (a) first receptacle and (b) second receptacle includes a locking tab for lockingly engaging with one of the plurality of slots. The one of the (a) first receptacle and (b) second receptacle moves in a linear motion with respect to the plurality of slots in the other one of the (a) first receptacle and (b) second receptacle such that the locking tab lockingly engages with one of the plurality of slots. The one of the (a) first receptacle and (b) second receptacle can be separated from the other one of the (a) first receptacle and (b) second receptacle by torsional rotation of one receptacle with respect to the other receptacle such that the locking tab disengages from the one slot of the plurality of slots.

The locking tab can comprise a curved (e.g., sloped) surface such that the torsional rotation causes an edge of the one of the plurality of slots to deflect the locking tab and disengage it from the one of the plurality of slots.

One of the (a) first receptacle and (b) second receptacle can further comprise a motion limiting tab, and the other one of the (a) first receptacle and (b) second receptacle further comprises a motion limiting slot, with the motion limiting tab engaging with the motion limiting slot for limiting motion of the first receptacle with respect to the second receptacle.

The retaining device can further comprise a retaining tab disposed at an edge of a cord receiving slot that is in communication with the opening extending from the first open end to the second open end of at least one of the first receptacle and the second receptacle. The retaining tab removably holds the wire portion of the power cord within the opening of the receptacle.

The first receptacle may receive a portion of one of the power cords and the first coupler, and the second receptacle may receive a portion of the other power cord and the second coupler. The first receptacle and the second receptacle are joined such that separating motion of the first coupler and the second coupler is limited by the motion limiting members of the first receptacle and the second receptacle.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

The retaining device formed in accordance with the present invention includes a single assembly of two parts that are moved with respect to each other in order to accept and retain a mated pair of cords in secure mechanical and electrical contact under adverse conditions as described previously. These two parts are also manipulated in order to release the mated power cords from the assembled device. Essentially, no separation of the device parts occurs during its use or storage for later use. The device is manipulated by manually pushing and twisting to secure the mated cords and twisting and pulling to release the mated cords.

Figure 2:
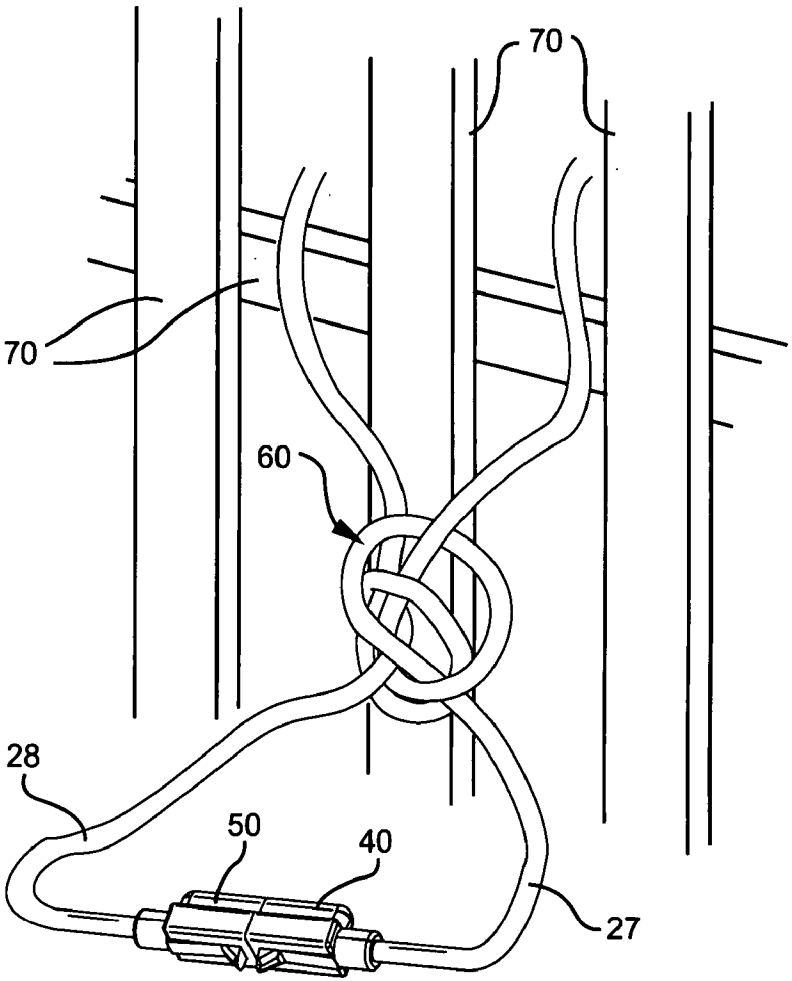
FIG. 2 PRIOR ART
FIG. 2 is an illustration of a difficulty resulting from the prior art method of FIG. 1.
Figure 1:
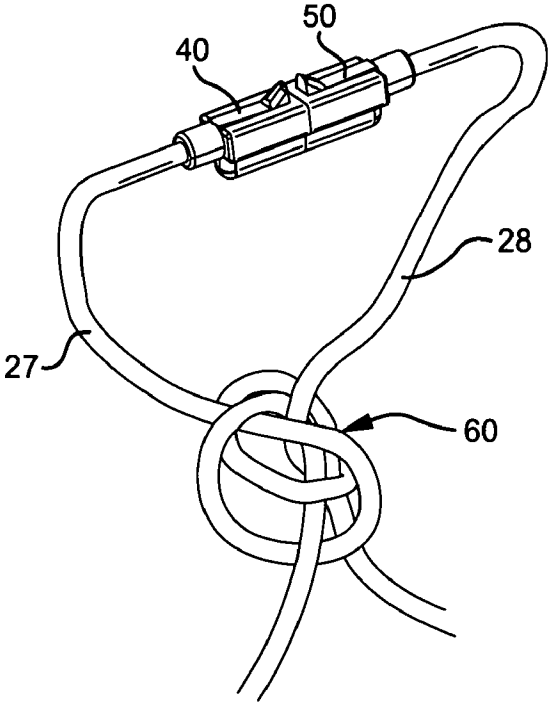
FIG. 1 PRIOR ART
FIG. 1 is an illustration of a prior art method of joining a plug and socket of two electrical power cords.
Figure 3A:
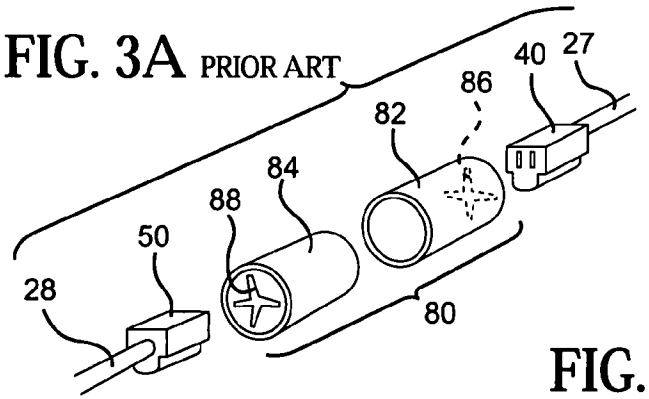
FIG. 3A PRIOR ART
FIG. 3A is an exploded perspective view of a prior art retaining device.
Figure 3B:
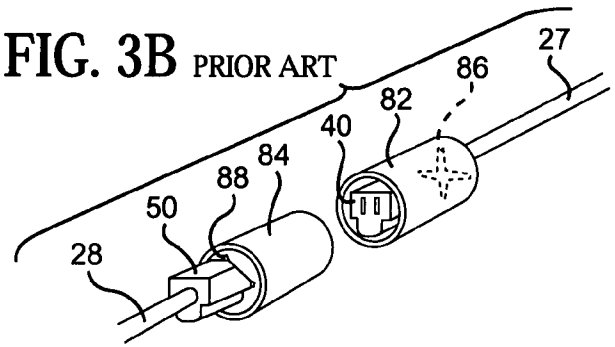
FIG. 3B PRIOR ART
FIG. 3B is a perspective view of the prior art retaining device of FIG. 3A illustrating electrical power cords being inserted thereinto.
Figure 3C:
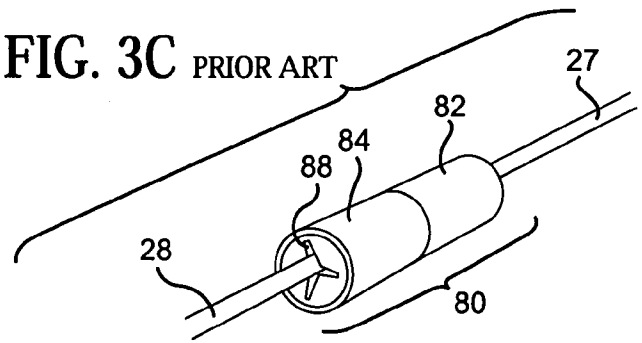
FIG. 3C PRIOR ART
FIG. 3C is a perspective view of the prior art retaining device of FIG. 3B in a coupled position.
Figure 4:
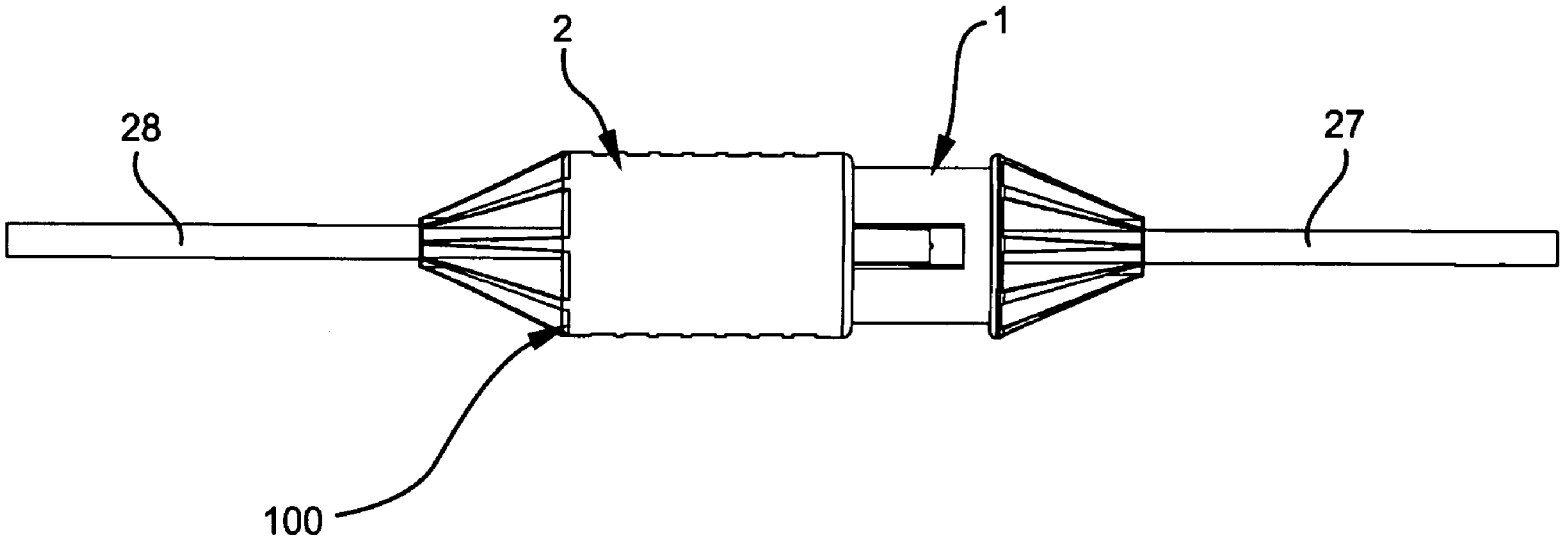
FIG. 4 is a bottom view of the retaining device of the present invention.

Specifically referring to FIG. 4, the retaining device 100 is illustrated fully retaining power cords 27 and 28. The retaining device 100 is comprised of a first receptacle 1 and a second receptacle 2.

Figure 5:
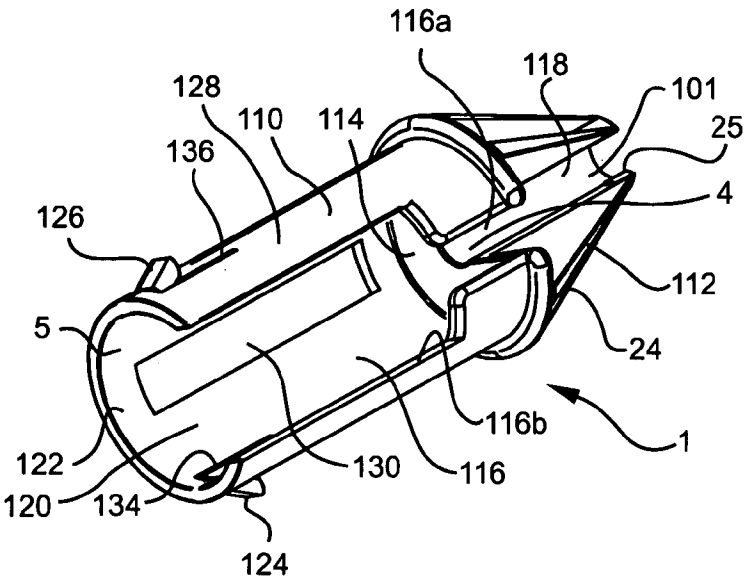
FIG. 5 is a perspective view of a portion of the retaining device of the present invention.

FIG. 5 is a perspective view of the first receptacle 1. The first receptacle 1 is comprised of a cylindrical male inner piece 110 and a cone-shaped end piece 112 joined to a first axial end of the male inner piece 110. A first open end 101 is formed in the end piece 112 and a second open end 5 is formed in the male inner piece 110 at its opposite second axial end. The end piece 112 is joined to the male inner piece 110 with a plate-like motion limiting member 114 disposed therebetween and extending radially across the interior space of the male inner piece 110 at its first axial end. A wire receiving slot 4 is formed in the motion limiting member 114, which is a load bearing member. The end piece 112 preferably includes slanted fins 24 to provide a sloped transition between the periphery of the motion limiting member 114 and the first open end 101, the fins 24 being spaced apart circumferentially about the surface of the end piece and extending radially therefrom. An opening 116 is formed in both the male inner piece 110 and the end piece 112. The opening 116 is transverse to the first open end 101 and the second open end 5. The opening 116 extends axially preferably from the first open end 101 to the second open end 5 and further includes a narrow portion 116*a* defined as a central bore which passes axially through the end piece 112, and a wide portion 116*b* defined as the interior space of the male inner piece 110. The narrow portion 116*a* of the opening 116 communicates with an exposed cord receiving slot 118 formed in the end piece 112. Either of the cords 27 and 28 can be received by the cord receiving slot 118. At the edges of the cord receiving slot 118, and proximate to the first open end 101, are small protrusions or retainer tabs 25 disposed on either or both opposite edges of the cord receiving slot 118 and partially protruding thereinto. The retaining tabs 25 help retain the cord 27, 28 in the narrow portion 116*a* of the opening 116. Preferably, the narrow portion 116*a* of the opening 116 extends into the male inner piece 110. The narrow portion 116*a* extending into the male inner piece 110 and the wide portion 116*b*, which is formed in the male inner piece 110, communicate with an inner chamber 120. The inner chamber 120 is bounded by the inner wall 122 of the male inner piece 110. The inner chamber 120 receives either the coupler or socket 40 of one power cord 27 or the coupler or plug 50 of the other power cord 28. Resilient locking tabs 124 and 126 are formed preferably diametrically opposed to each other on the outer wall 128 of the male inner piece 110 and extend outwardly therefrom and angularly thereto. Preferably, a slot 130 is also formed in the male inner piece 110 through the thickness of the sidewall thereof for limiting motion, to be explained later.

Figure 6:
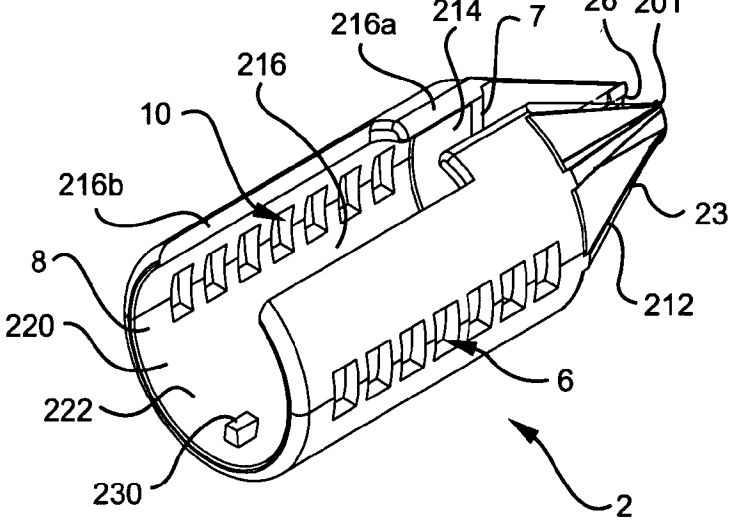
FIG. 6 is a perspective view of another portion of the retaining device of the present invention.

FIG. 6 is a perspective view of the second receptacle 2. The second receptacle 2 is comprised of a cylindrical female outer piece 210 and a cone-shaped end piece 212 joined to a first axial end of the female inner piece 210. A first open end 201 is formed in the end piece 212 and a second open end 8 is formed in the female outer piece 210 at its opposite second axial end. The end piece 212 is joined to the female outer piece 210 with a plate-like motion limiting member 214 disposed therebetween and extending radially across the interior space of the female outer piece 210 at its first axial end. A wire receiving slot 7 is formed in the motion limiting member 214, which is a load bearing member. The end piece 212 preferably includes slanted fins 23 to provide a sloped transition between the periphery of the motion limiting member 214 and the first open end 201, the fins 23 being spaced apart circumferentially about the surface of the end piece and extending radially therefrom. An opening 216 is formed in both the female outer piece 210 and the end piece 212. The opening 216 is transverse to the first open end 201 and the second open end 8. The opening 216 extends, preferably, axially from the first open end 201 to the second open end 8 and further includes a narrow portion 216*a* defined as a central bore which passes axially through the end piece 212 and a wide portion 216*b* defined as the interior space of the female outer piece 210. The narrow portion 216*a* of the opening 216 communicates with an exposed cord receiving slot 218 formed in the end piece 212. Either of the cords 27 and 28 can be received by the cord receiving slot 218. At the edges of the cord receiving slot 218, and proximate to the first open end 201 are small protrusions or retainer tabs 26 disposed on either or both opposite edges of the cord receiving slot 218 and partially protruding thereinto. The retaining tabs 26 help retain the cord 27, 28 in the narrow portion 216*a* of the opening 216. Preferably, the narrow portion 216*a* of the opening 216 extends into the female outer piece 210. The narrow portion 216*a* extending into the female outer piece 210 and the wide portion 216*b*, which is formed in the female outer piece 210, communicate with an inner chamber 220. The inner chamber 220 is bounded by the inner wall 222 of the female outer piece 210. The inner chamber 220 receives either the coupler or socket 40 of one power cord 27 or the coupler or plug 50 of the other power cord 28. A plurality of linearly arranged, spaced apart slots or openings, shown as 6*i* through 6*o* and 10*i* through 10*o* (referred to collectively as 6 and 10, respectively) are formed diametrically on opposite sides of the female outer piece 210. The linearly arranged slots or openings 6 and 10 are engaged by the locking tabs 124 and 126 situated on the outer wall 128 of the male inner piece 110. A movement limiting tab 230 is formed in the inner wall 222 and protrudes partially into inner chamber 220 to engage with the motion limiting slot 130 formed in the male inner piece 110.

Those skilled in the art recognize that the linearly arranged slots or openings 6 and 10 can also be formed instead in the male inner piece 110 and the locking tabs 124 and 126 can be formed on the female outer piece 210.

Figure 7:
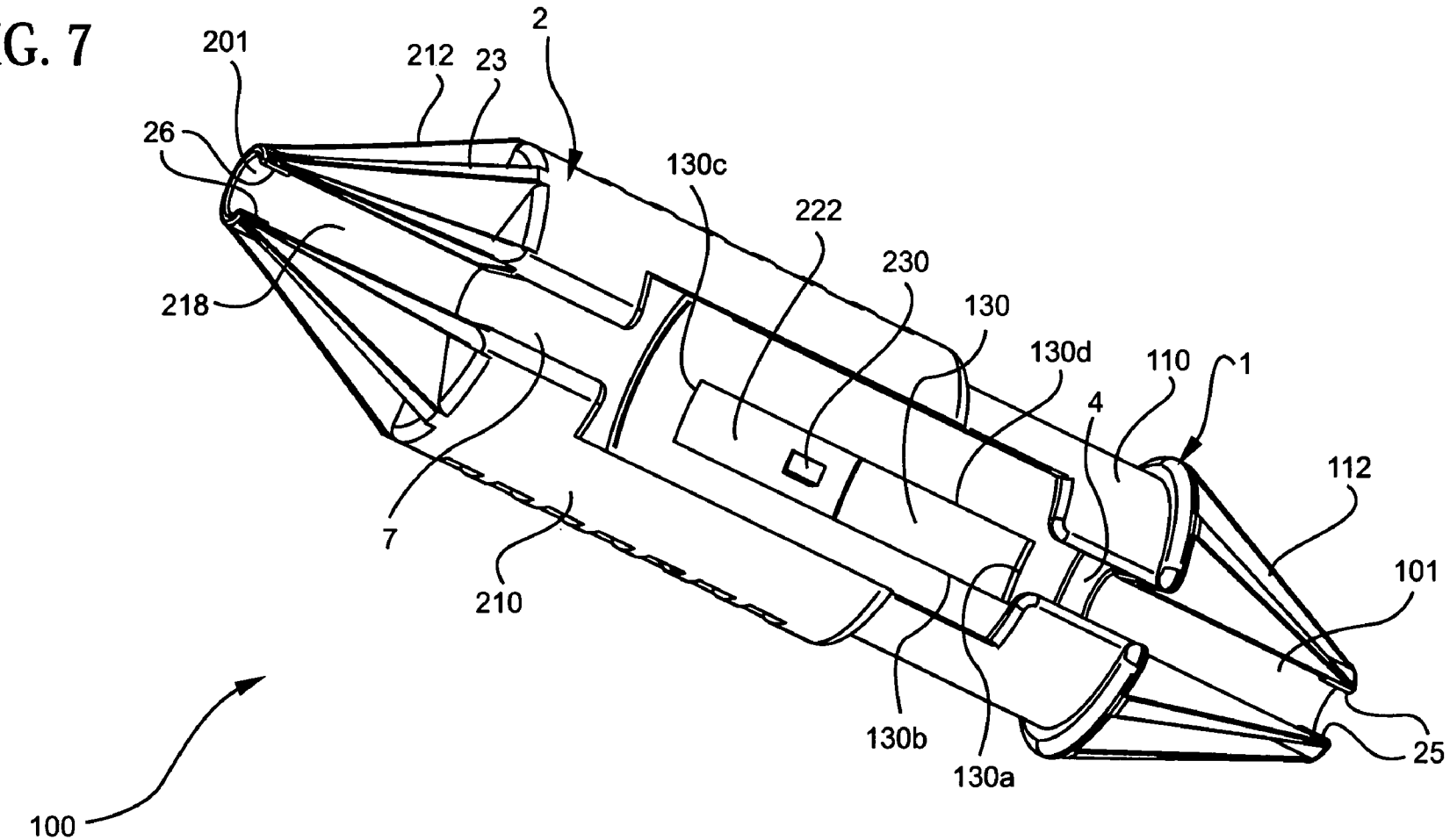
FIG. 7 is a perspective view of the portions of the retaining device of FIG. 5 and FIG. 6 coupled together.

FIG. 7 is a perspective view of the first receptacle 1 and the second receptacle 2 joined together. The male inner piece 110 is shown partially inserted within the female outer piece 210. The tab 230 in the inner wall 222 of the second receptacle 2 engages with the motion limiting slot 130 of the first receptacle 1. The edges 130*a*, 130*b*, 130*c* and 130*d* of the motion limiting slot 130 act as barriers limiting the motion of the tab 230, and consequently, limiting the motion of the first receptacle 1 with respect to the second receptacle 2. Linear motion is limited by edges 130*a* and 130*c*, while torsional rotational, i.e., twisting, motion is limited by edges 130*b* and 130*d*. Thus, the first and second receptacles 1, 2 define the retaining device with a telescopically expandable and retractable central portion having opposite axial ends and at least partially overlapping side walls which together define an interior space for receiving the coupled plug and socket of the electrical power cords, the end pieces being affixed to the opposite axial ends of the central portion.

Figure 8:
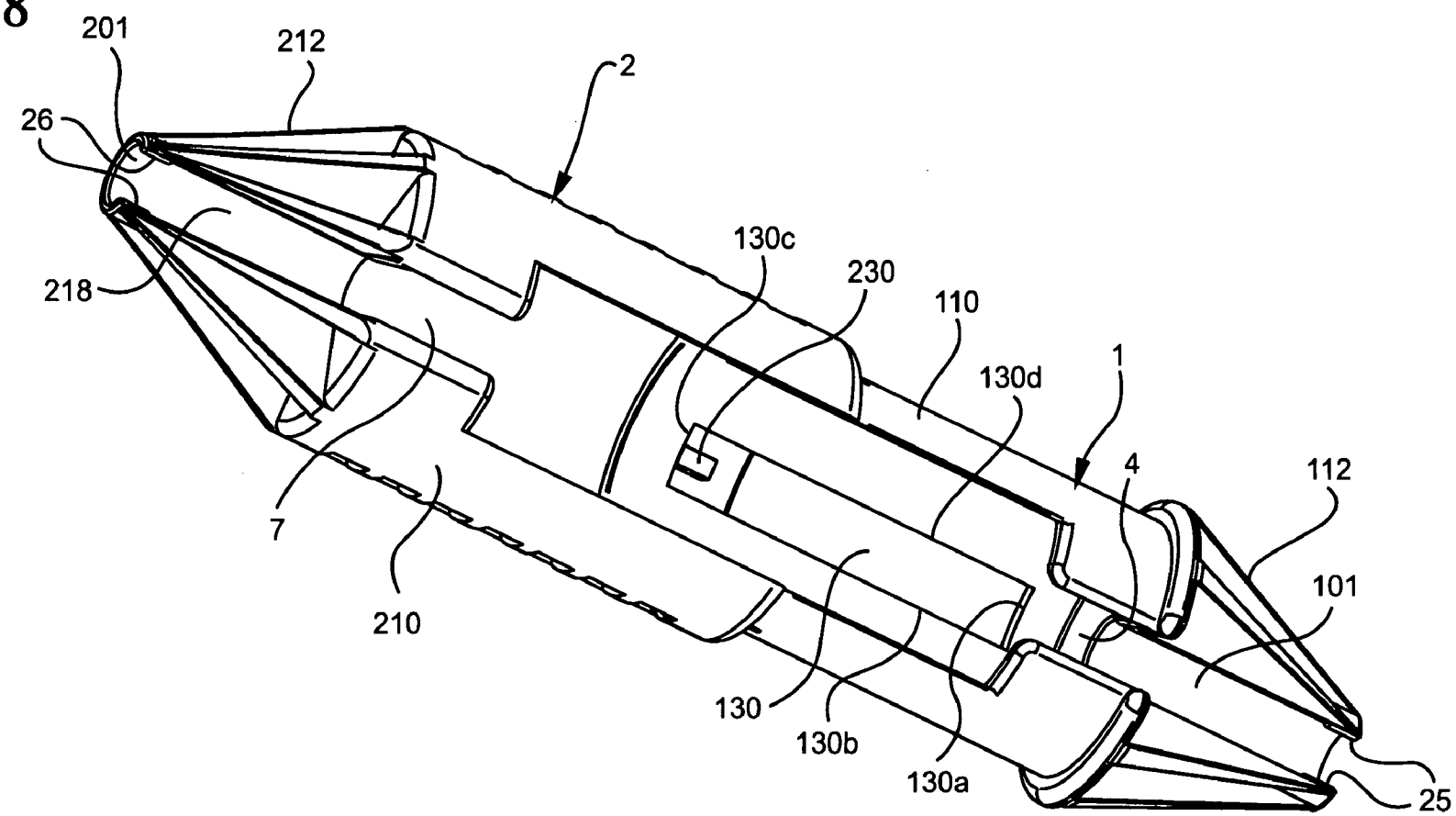
FIG. 8 is another perspective view of the portions of the retaining device of FIG. 5 and FIG. 6.

FIG. 8 is another perspective view of the first receptacle 1 and the second receptacle 2 joined together. In FIG. 8, the male inner piece 110 is shown fully extended away from the female outer piece 210. The tab 230 in the inner wall 222 of the second receptacle 2 remains engaged within the motion limiting slot 130 of the first receptacle 1. In this case, the tab 230 is in contact with and is substantially prevented from further linear motion by edge 130*c*. Therefore, further linear motion of the first receptacle 1 with respect to the second receptacle 2 is substantially prevented in order to prevent the first and second receptacles from disengaging from one another.

Figure 9:
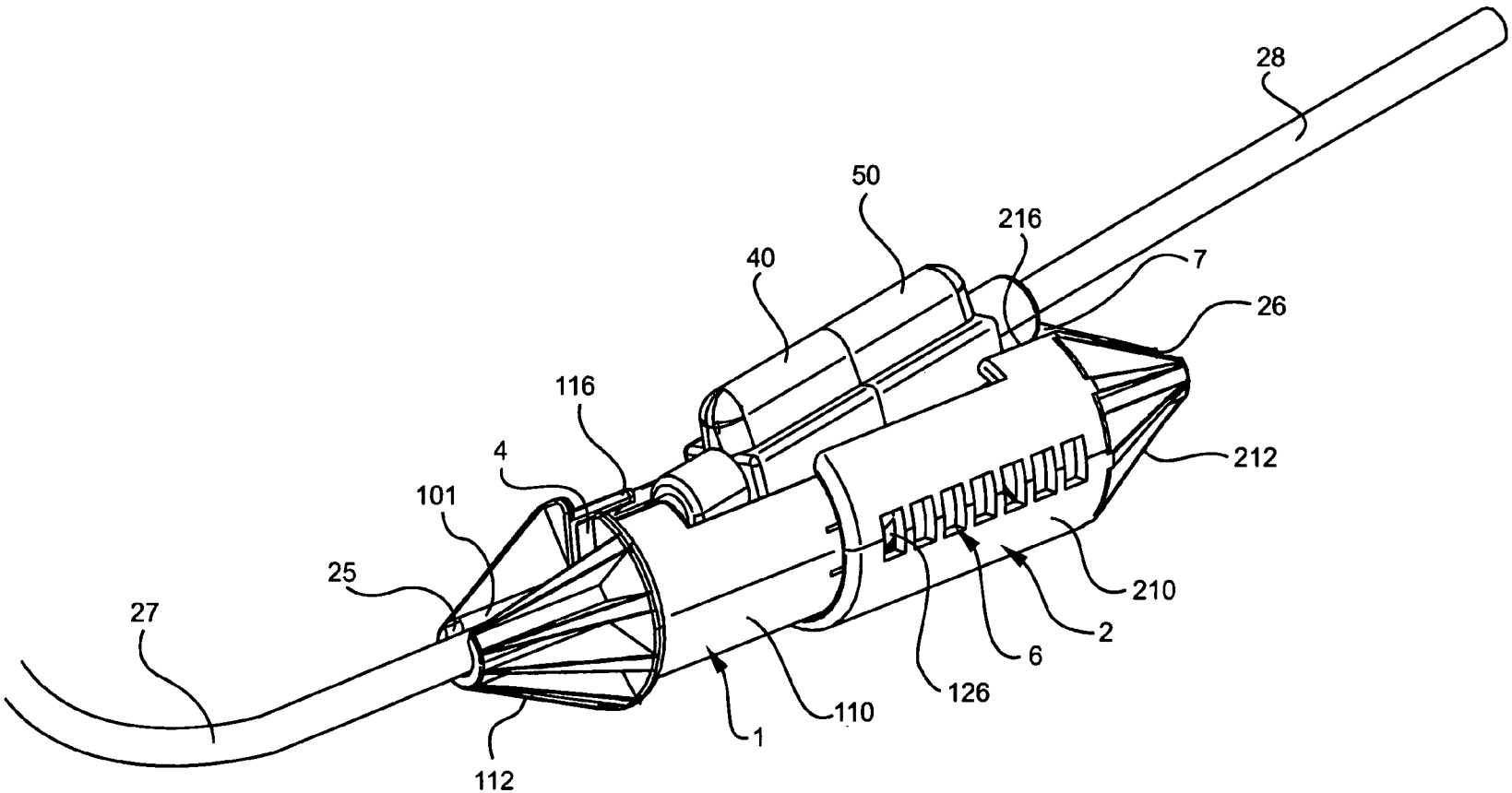
FIG. 9 is a perspective view illustrating the initial steps of the method of using the retaining device of the present invention to retain the mated ends of a pair of coupled power cords.

FIG. 9 illustrates the initial steps of the method of using the retaining device 100. The first receptacle 1 and the second receptacle 2 are shown fully extended away from each other and the locking tabs 124 and 126 are engaged within the desired slots 6 and 10, in this case, the extreme end slots of slots 6*i* and 10*i* to provide the fully extended position. The first power cord 28 and its coupler or plug 50 are coupled to coupler or socket 40 of the second power cord 27. The cord 28 is shown as it is initially introduced into the opening 116 extending from the inner male piece 110 and the end piece 112. The coupler or plug 50 and socket 40 with cord 27 are subsequently begun to be introduced into openings 116 and 216. The combined volume of the openings 116 and 216 varies depending upon the degree of insertion of the first and second receptacles 1 and 2 with respect to each other.

Figure 10:
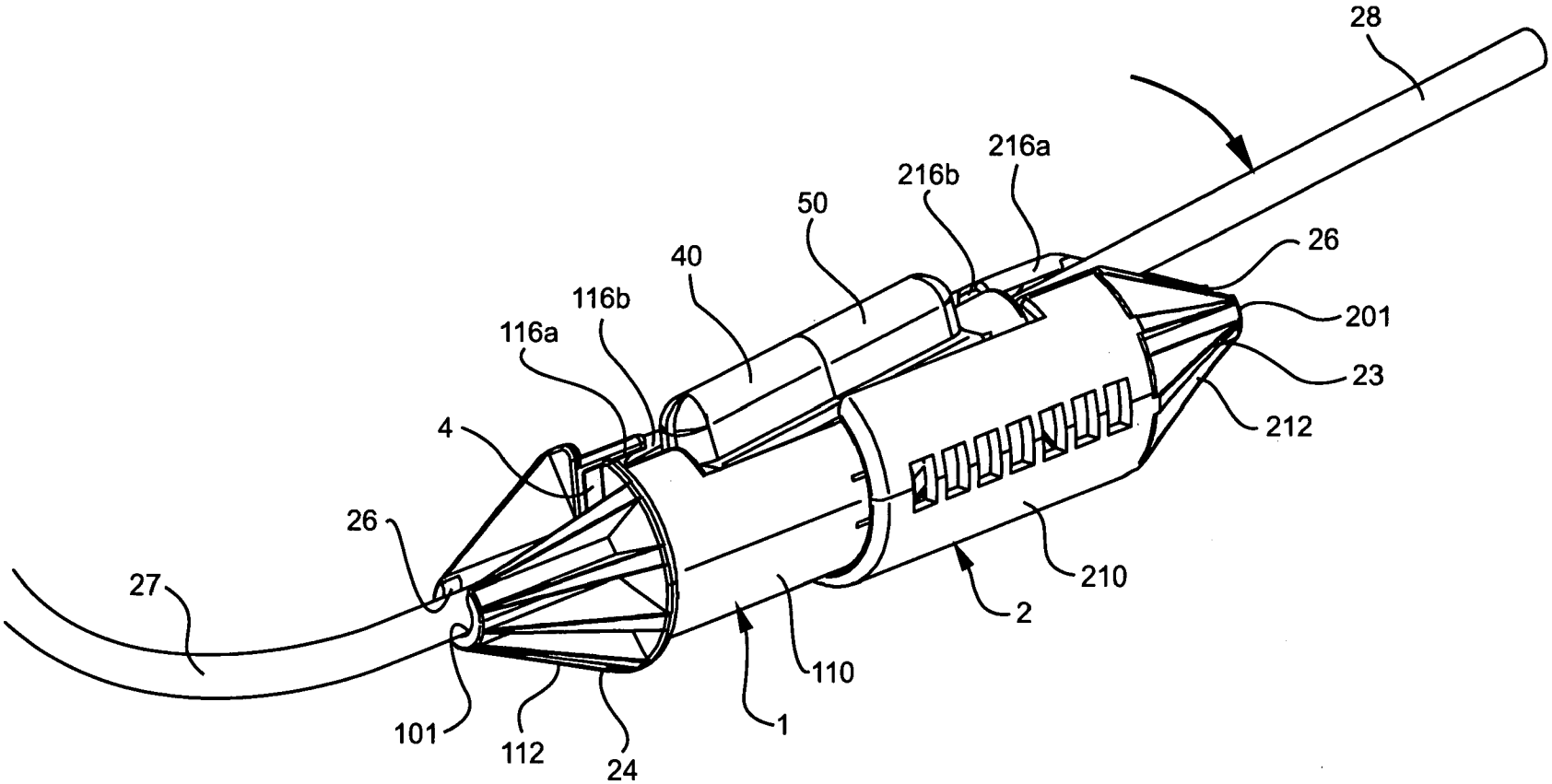
FIG. 10 is a perspective view illustrating additional steps of the method of using the retaining device of the present invention to retain the mated ends of a pair of coupled power cords.

FIG. 10 illustrates additional steps of the method of using the retaining device 100. In particular, the plug 50 or socket 40, depending upon the user's choice, is introduced through the wide portion 216*b* of the opening 216 while the cord 28 is introduced through the narrow portion 216*a* of the opening 216.

Figure 11:
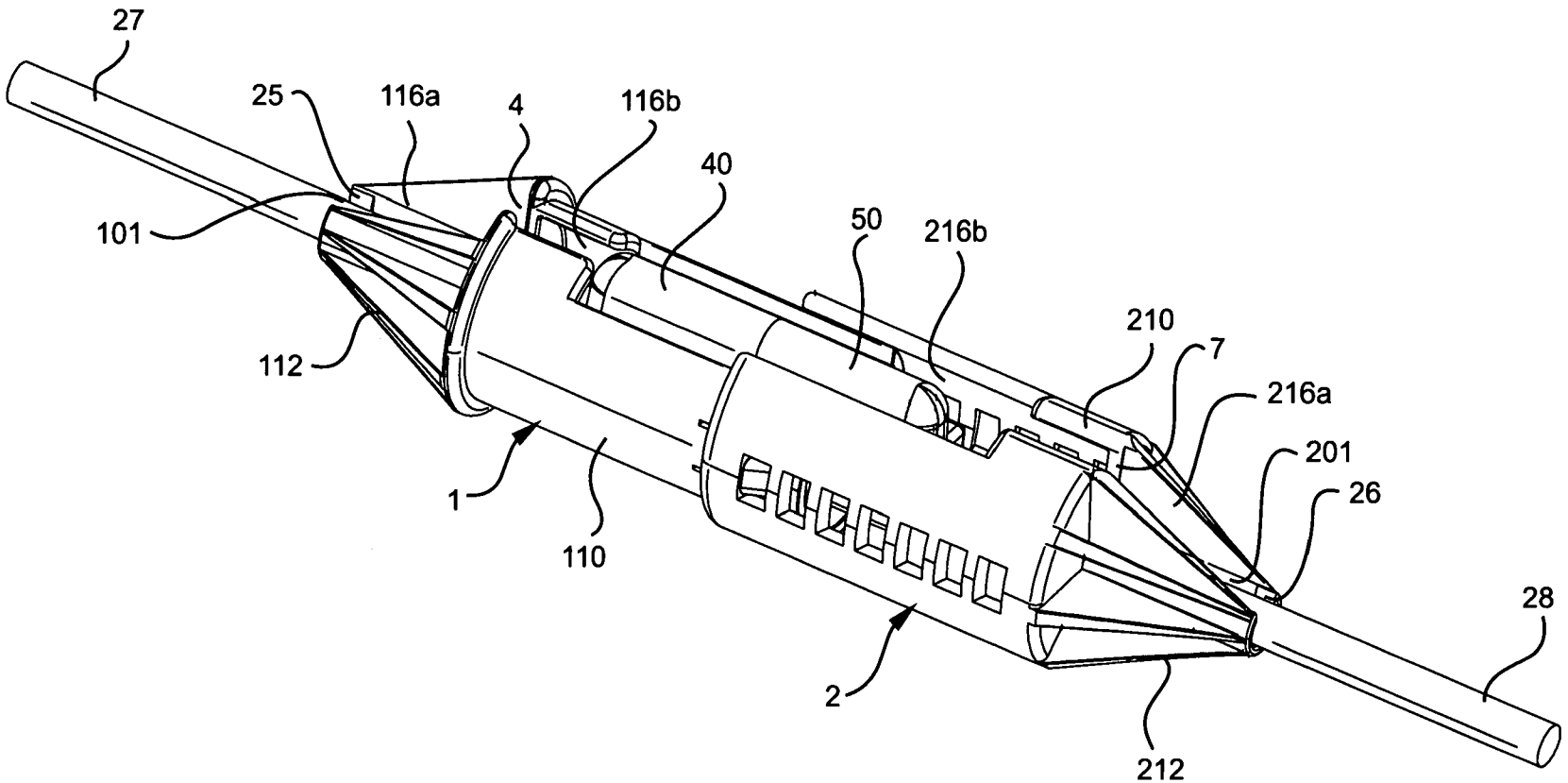
FIG. 11 is a perspective view illustrating further steps of the method of using the retaining device of the present invention to retain the mated ends of a pair of coupled power cords.

FIG. 11 illustrates that the coupled power cords 27 and 28 are now seated inside the central bores or narrow openings 116*a*, 216*a* of the end pieces 112, 212, respectively, and are held in place by means of retainer tabs 25 and 26 disposed on either side of the cord receiving slots 118 and 218 for retaining the cords 27 and 28 at the first open ends 101 and 201, respectively.

Figure 12:
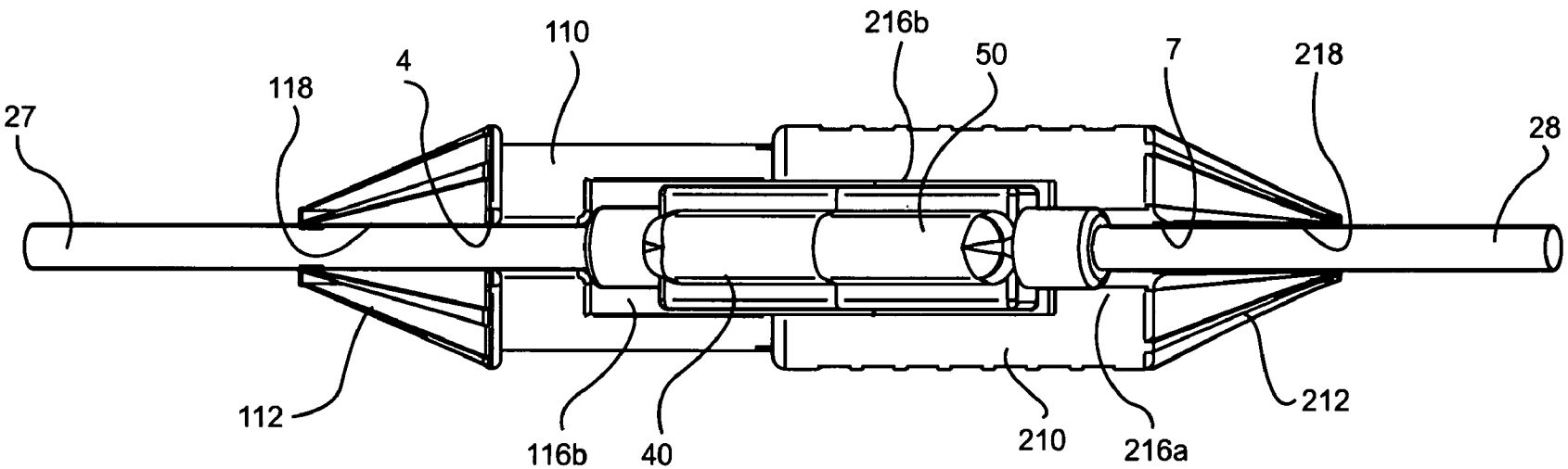
FIG. 12 is a top view illustrating the retaining device of the present invention having received the ends of a pair of coupled power cords.

FIG. 12 is a plan view illustrating the steps of the method of using the retaining device 100. In particular, socket 50 and cord 28 are shown prior to being fully inserted through cord receiving slot 218.

Figure 13:
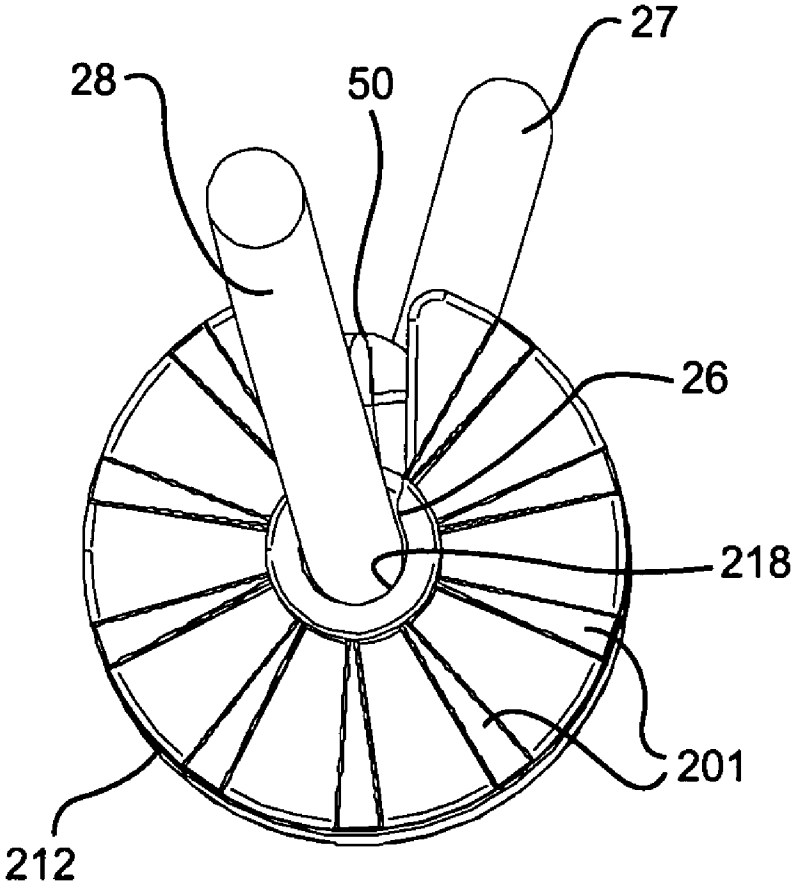
FIG. 13 is an end perspective view of a portion of the retaining device of the present invention with a power cord extending therefrom.

FIG. 13 is an end perspective view illustrating the steps of the method of using the retaining device 100. When viewed towards first open end 201, the cord 28 is pushed into the narrow opening 216*a* towards the retaining tabs 26 and through the cord receiving slot 218 and into the central bore or narrow opening 216*a* of end piece 212. Those skilled in the art recognize that the analogous method is used to push cord 27 into the narrow opening 116*a* of the first open end 101.

Figure 14:
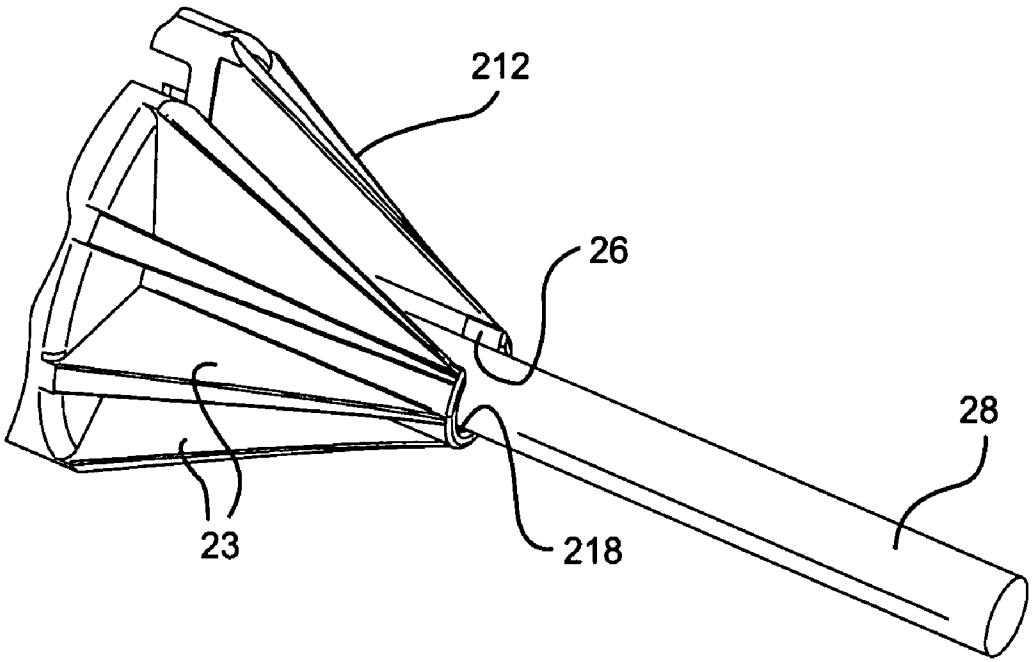
FIG. 14 is another end perspective view of a portion of the retaining device of the present invention with a power cord extending therefrom.

FIG. 14 is another end perspective view illustrating the steps of the method of using the retaining device 100. When viewed again towards first open end 201, the cord 28 has now been pushed completely through the cord receiving slot 218 and into the central bore or narrow opening 216*a* and is locked in place by the retaining tabs 26.

Figure 15:
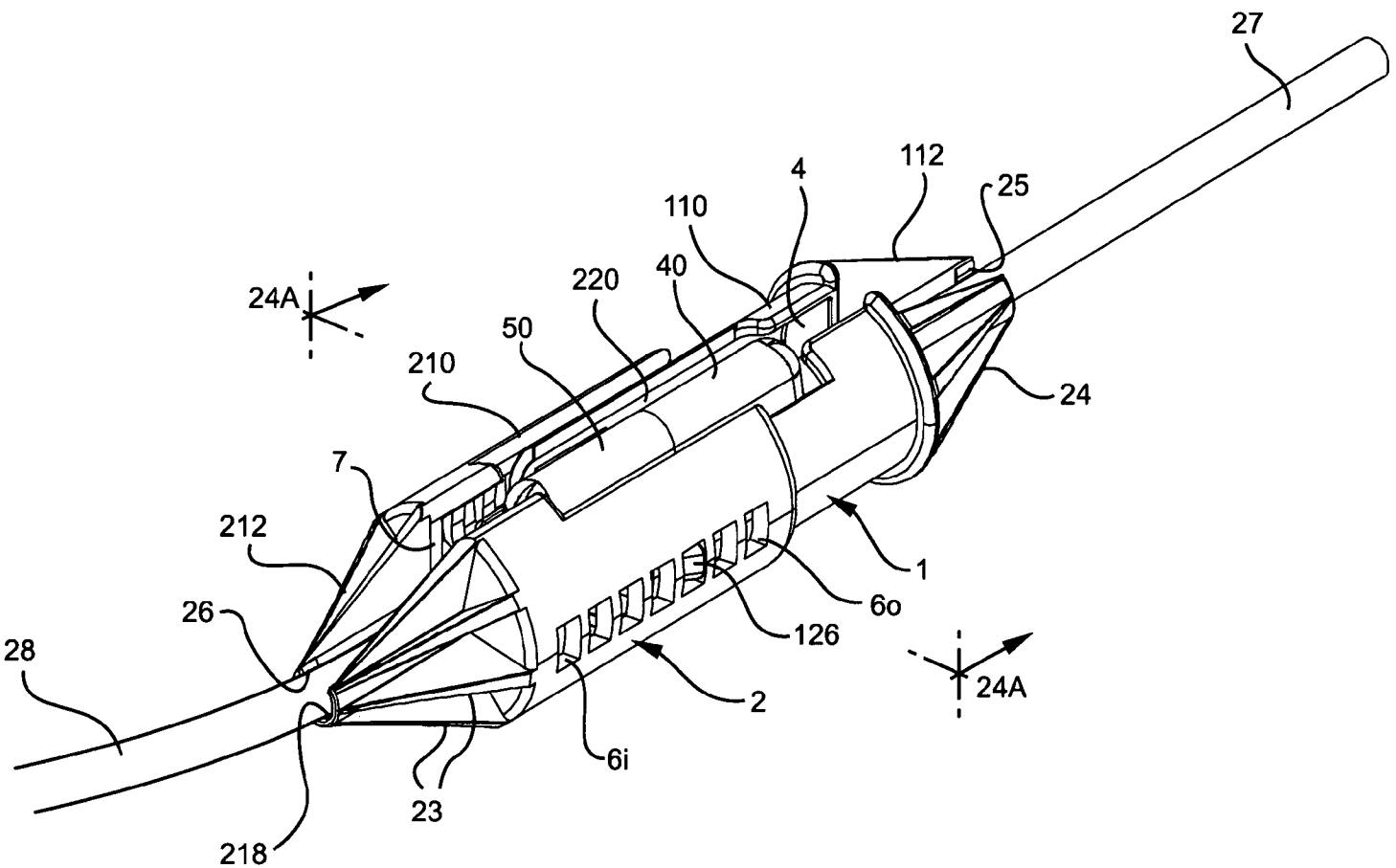
FIG. 15 is a perspective view of the retaining device of the present invention illustrating the device retaining the mated ends of a pair of coupled power cords.

FIG. 15 is a perspective view illustrating the final steps of the method of using the retaining device 100. Once the end portions of cords 27 and 28 have been fully inserted into the cord receiving slots 118 and 218, respectively, the final step is to push the first receptacle 1 and second receptacle 2 in a co-axial direction towards each other such that, if necessary, depending upon the total length of the couplers 40 and 50, the locking tabs 124 and 126 disengage from the extreme outer slots 6*i* and 10*i* and reengage in one of the intermediate slots 6*j* through 6*n* and 10*j* through 10*n*.

Figure 16:
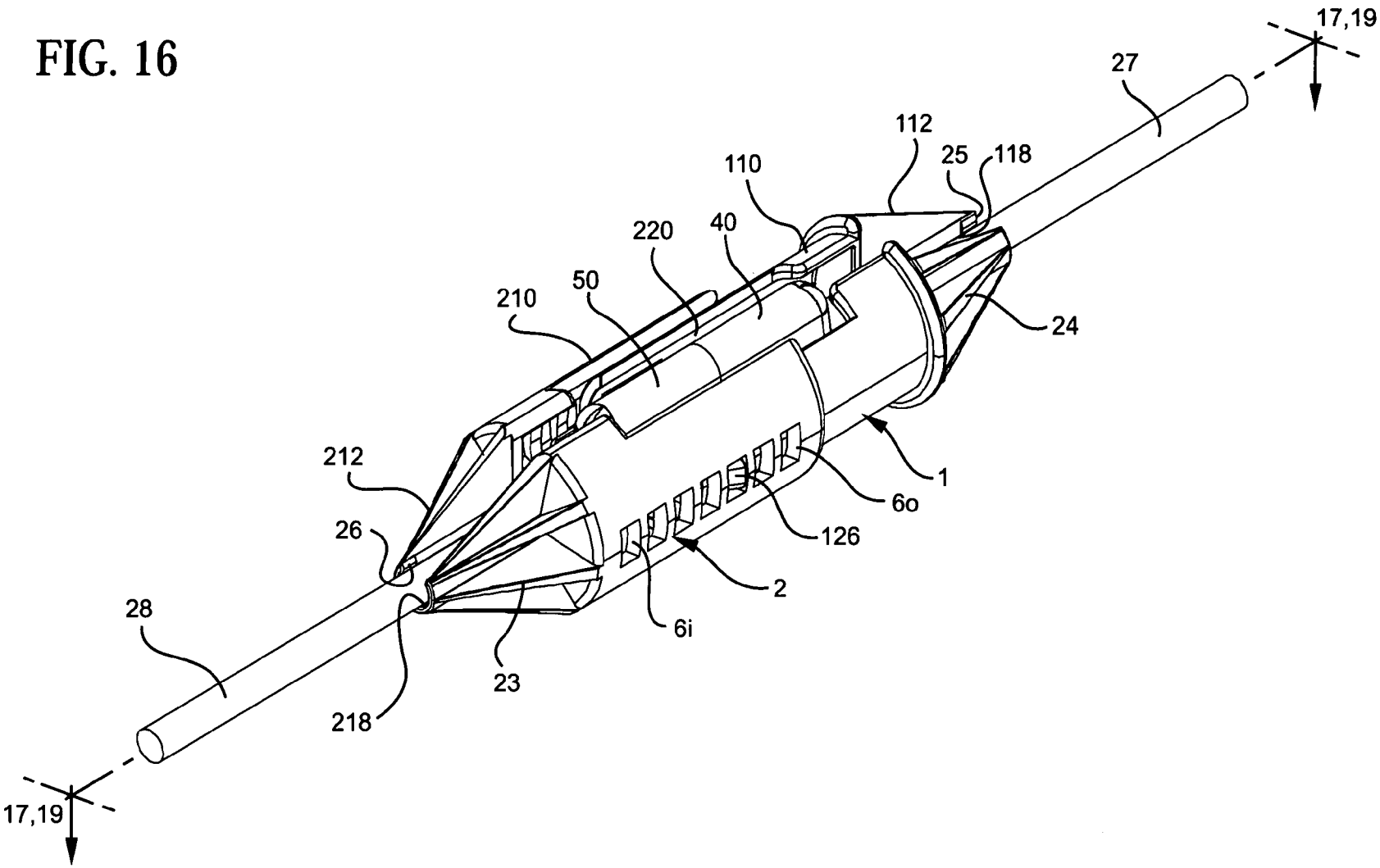
FIG. 16 is a perspective view of the retaining device of the present invention upon completion of the steps to retain a pair of coupled power cords.

FIG. 16 is a perspective view of the retaining device 100 upon completion of the method steps. The end portions of cords 27 and 28 are now fully inserted into the cord receiving slots 118 and 218 and the couplers 40 and 50 are now fully inserted into the inner chambers 120, 220 and are retained by the retaining device 100. It should be noted that inner chamber 220 can partially or completely overlap inner chamber 120.

Figure 17:
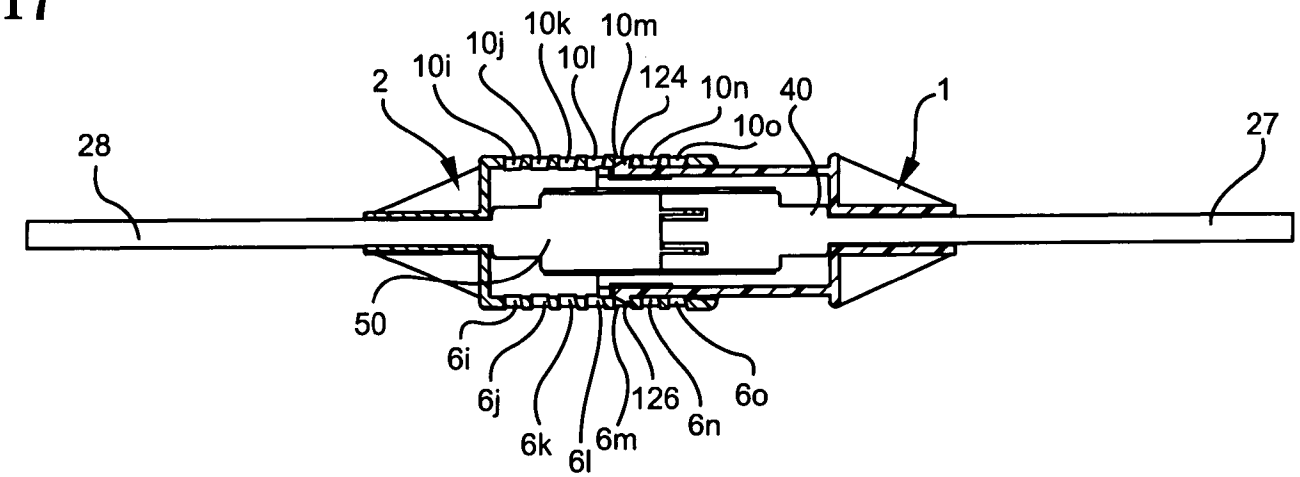
FIG. 17 is a cross-section view of the retaining device of the present invention taken along line 17—17 of FIG. 16.

FIG. 17 is a cross-sectional view taken along line 17—17 of FIG. 16. The end portions of cords 27 and 28 are fully inserted through the cord receiving slots 118 and 218, respectively, and into narrow openings 116*a*, 116*b*, respectively, of the end pieces. The socket 40 is disposed such that a surface 42 acts as a contact surface with the motion limiting member 214 of the second receptacle 2. Similarly, the plug 50 is disposed such that surface 52 acts as a contact surface with the motion limiting member 114 of the first receptacle 1. Preferably, the number and extent of the plurality of slots 6 and 10, and the locking tabs 124 and 126, and the axial lengths of the cylindrical male inner piece 110 and the cylindrical female outer piece 210 are such that chambers 120 and 220 may receive and accommodate portions of a coupled pair of power cords 27, 28, and their respective couplers 40, 50. Preferably, the resulting volume of the chambers 120 and 220 enables receipt of couplers 40, 50 having standard dimensions. Preferably, the contact surfaces 42 and 52 are in contact or in near contact with the motion limiting members 114 and 214 to form a tight fit without excessive slack to retain the couplers 40 and 50 in both an electrically and mechanically coupled state. Of course, those skilled in the art recognize that a slight gap between the contact surfaces 42 and 52 and their respective motion limiting members 114 and 214 will not adversely affect performance of the retaining device 100.

Figure 18:
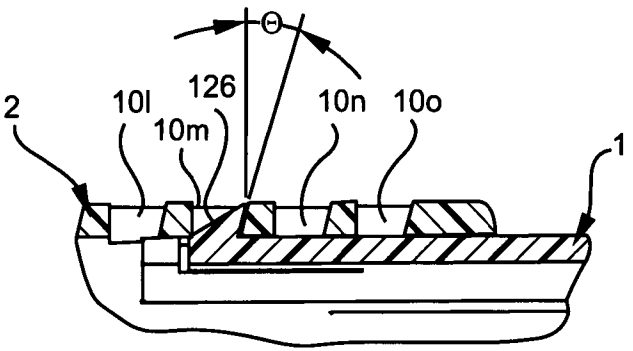
FIG. 18 is a partial detail view of a portion of the retaining device of FIG. 17.

FIG. 18 is a partial detailed view of the interface between the first receptacle 1 and second receptacle 2 illustrated in FIG. 17. Locking tab 126 is shown in the locked position in one of the slots 10. The locking tabs 124, 126 have a negative rake angle θ to prevent the longitudinal separation of the male inner piece 110 from the female inner piece 210 and to allow sliding engagement of the two pieces 110, 210 in one direction only so that the retaining device may be tightened against the couplers 40, 50 of the two power cords 27, 28 to hold them together.

Figure 19:
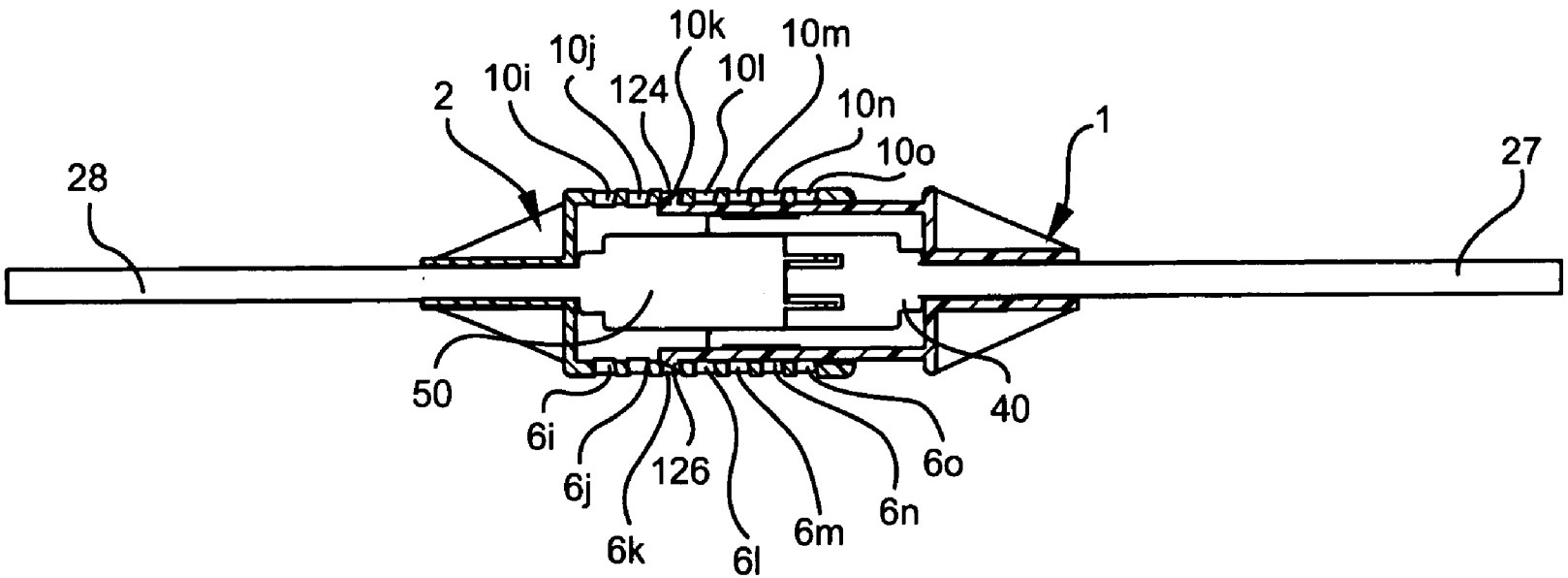
FIG. 19 is a cross sectional view of the retaining device of the present invention as illustrated in FIG. 17 but in a different elongation to accommodate a pair of coupled extension cords with couplers of different length as compared to those shown in FIG. 17.

FIG. 19 is another cross-section view of the retaining device shown in FIG. 17 taken along line 19—19 of FIG. 16, but illustrating how the retaining device may accommodate an elongated socket and plug. The cord 27 and socket 40 are shown coupled to plug 50 and cord 28 and held together by retaining device 100. The cord 27, socket 40, plug 50 and cord 28 are of lengths such that the first or male receptacle 1 is at least partially inserted into the second or female receptacle 2, the two receptacles being locked together by tabs 124, 126 and slots 6, 10.

Figure 20:
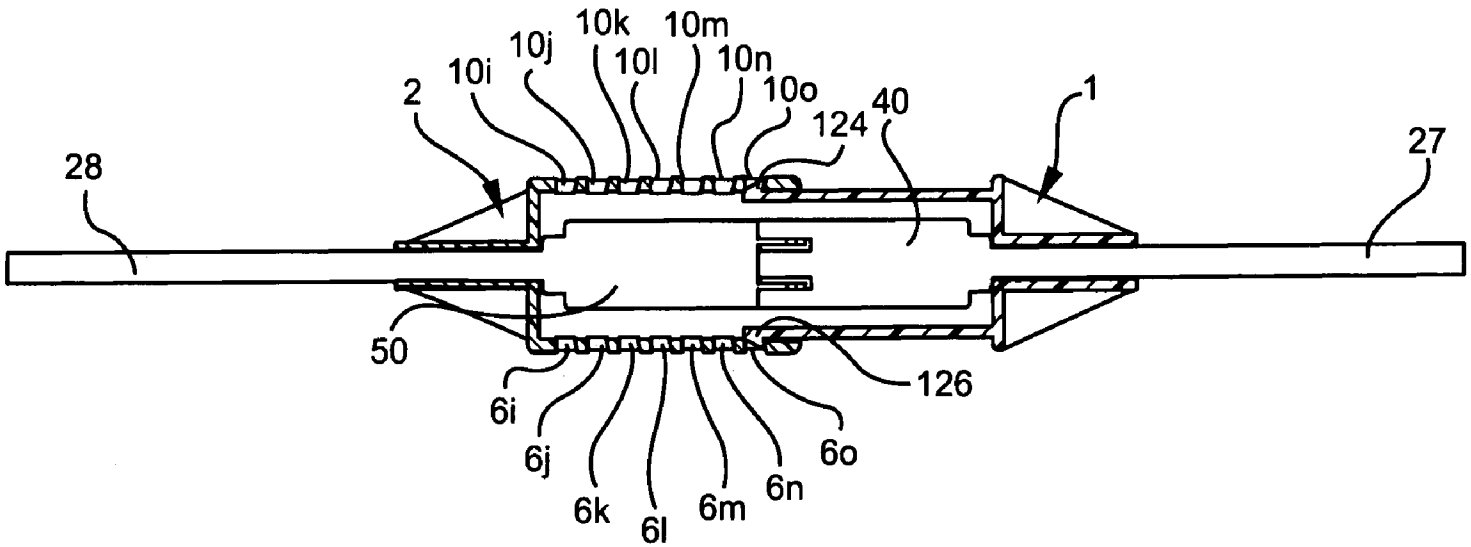
FIG. 20 is a cross sectional view of the retaining device of the present invention as illustrated in FIG. 17 but in yet another elongation to accommodate a pair of coupled extension cords.

FIG. 20 is another perspective view of the retaining device 100 as shown in FIG. 15. The cord 27 having an oversized (in length) socket 40 is coupled to oversized plug 50 of cord 28. This figure demonstrates that the retaining device 100 of the present invention may accommodate power cords having oversized couplers 40, 50. The cord 27, coupler 40, coupler 50 and cord 28 are of lengths such that the first or male receptacle 1 engages the second or female receptacle 2 near the free ends of each to define together a relatively large extended chamber for receiving the oversized couplers 40, 50. The locking tabs 124 and 126 lockingly engage in end slots 6*o* and 10*o* so that the male receptacle 1 is extended lengthwise away from the female receptacle 2.

Figure 21A:
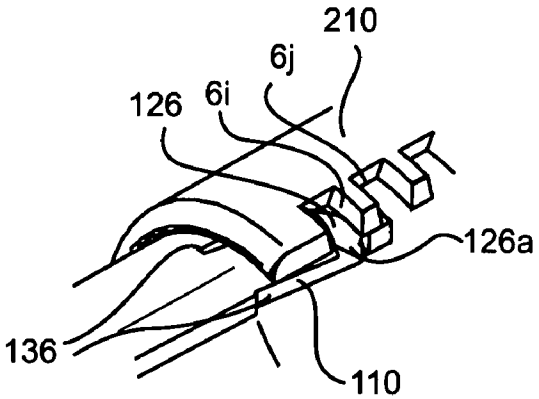
FIG. 21A is a perspective view of a portion of the retaining device shown in the partial detail view of FIG. 18.
Figure 21B:
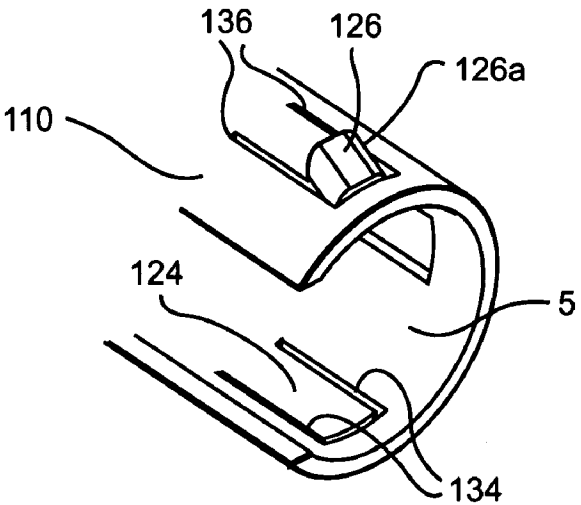
FIG. 21B is a perspective view of a portion of the retaining device of the present invention.

FIGS. 21A, 21B are enlarged perspective views of the free end portions of male inner piece 110 and female outer piece 210. The locking tabs 126 and 124 are preferably both sloped on their lateral sides and have at least one curved (e.g., sloped) surface 126*a*, 124*a* so that when the curved surface is pressed by rotation of the male inner piece 110 against an edge of the particular slot 6, 10 within which it is engaged, the rotation forces the locking tab 124, 126 to deflect downwardly so that the locking tab 124, 126 becomes disengaged from the particular slot 6,10, as shown in FIG. 21A, thereby releasing the male inner piece 110 from the female outer piece 210.

Figure 22:
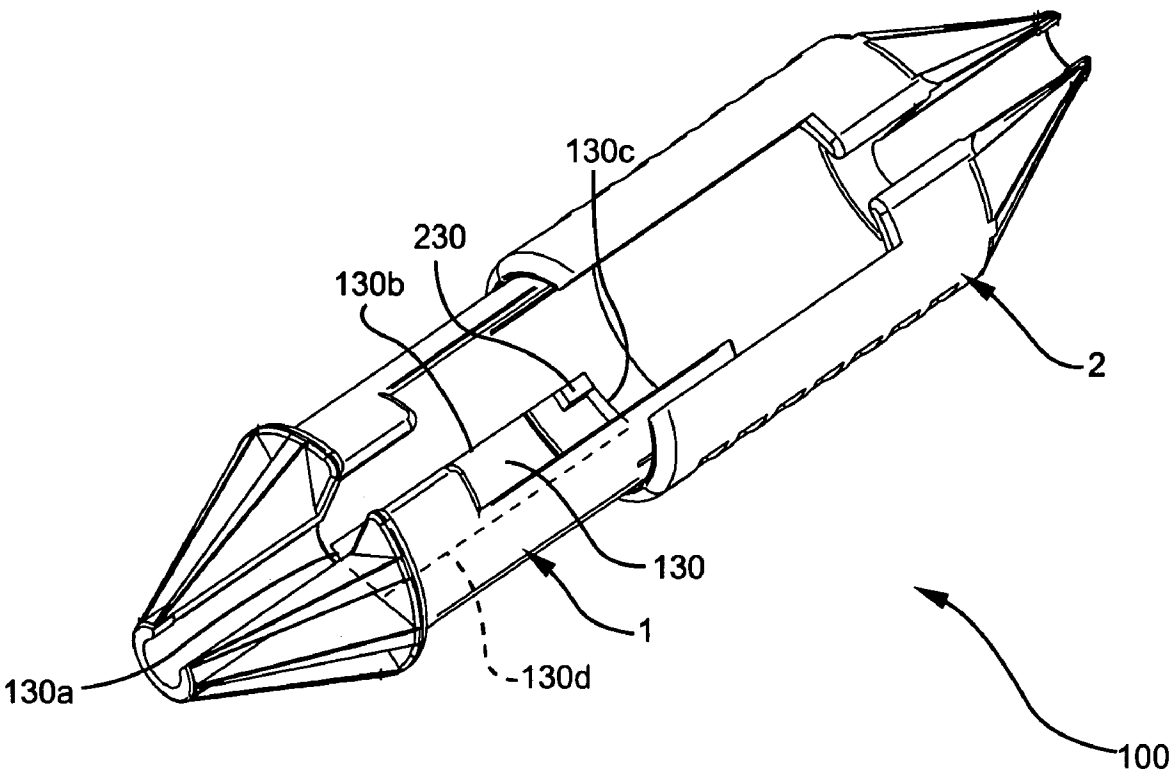
FIG. 22 is perspective view of the retaining device of the present invention in a fully extended position.

FIG. 22 is a perspective view of the retaining device 100. Rotation of the female receptacle 2 is limited by the slot 130 in the male receptacle 1. In particular, the motion limiting tab 230 abuts either edge 130*b* or 130*d* of the slot 130 to limit the rotation. The arcuate width of slot 130 is such as to allow partial rotation of male inner piece 110 with respect to female outer piece 210 so that tabs 124, 126 may be rotated out of engagement with slots 6, 10 to allow the male receptacle to be at least partially de-coupled from female receptacle 2 so that the two receptacles may move in opposite axial directions. The motion limiting tab 230 will engage the edge 130*c* of motion limiting slot 130 to prevent the two receptacles 1, 2 from becoming fully separated.

Figure 23:
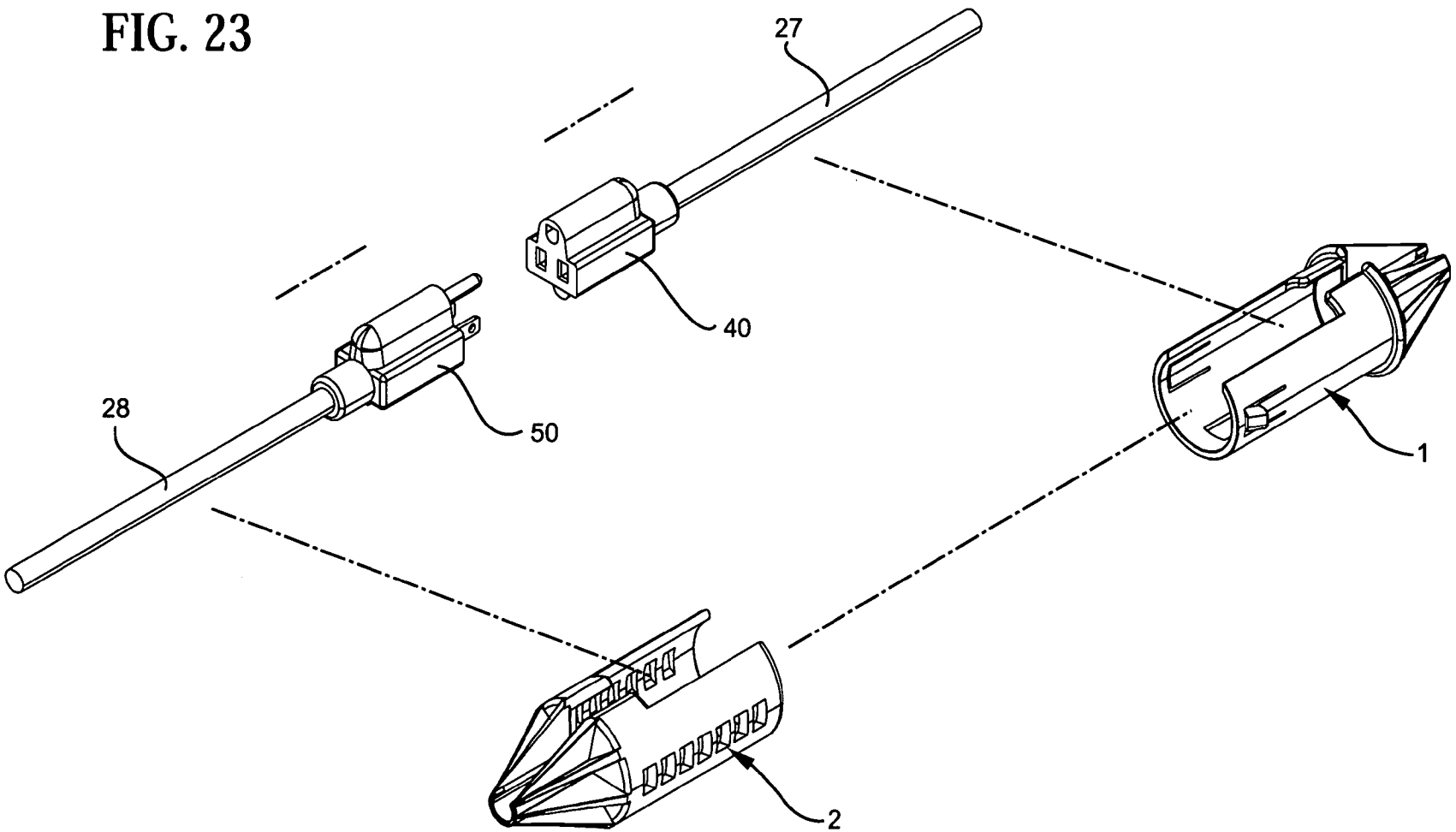
FIG. 23 is an exploded perspective view of the retaining device of the present invention and the ends of a pair of power cords which are to be received by the retaining device.
Figure 24A:
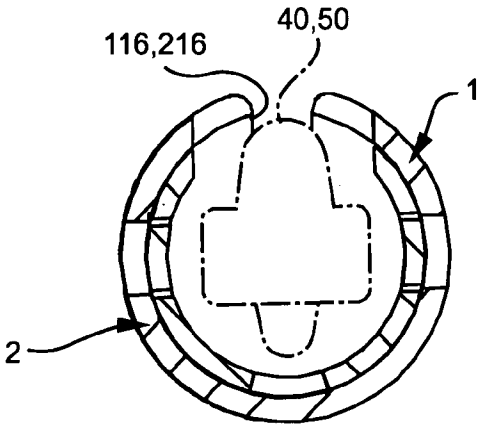
FIG. 24A is a cross-sectional view of the retaining device taken along line 24A—24A of FIG. 15 illustrating one orientation of the couplers within the retaining device of the present invention.
Figure 24B:
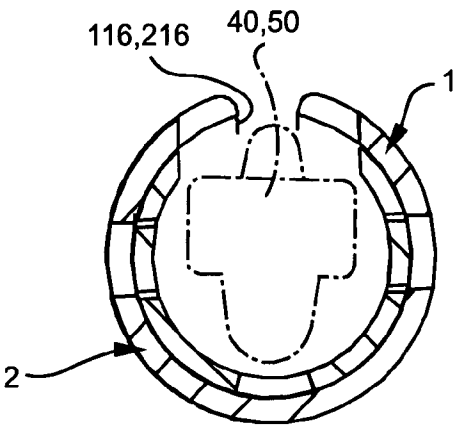
FIG. 24B is a cross-sectional view of the retaining device which is similar to the view shown in FIG. 24A but illustrating another orientation of the couplers within the retaining device of the present invention.
Figure 24C:
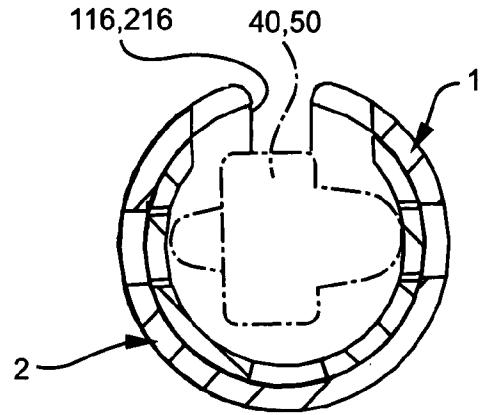
FIG. 24C is a cross-sectional view of the retaining device which is similar to the view shown in FIG. 24A but illustrating yet another orientation of the couplers within the retaining device of the present invention.
Figure 24D:
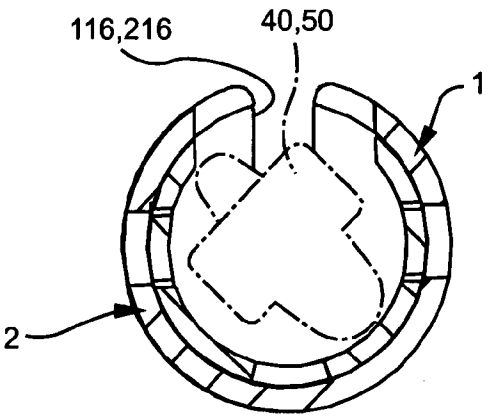
FIG. 24D is a cross-sectional view of the retaining device which is similar to the view shown in FIG. 24A but illustrating still another orientation of the couplers within the retaining device of the present invention.

FIG. 23 is an exploded perspective view of the retaining device 100 showing the power cord 27 and socket 40, the power cord 28 and its plug 50, and the first receptacle 1 and second receptacle 2, prior to the receptacles being joined together to receive the plug 50 and socket 40 of the power cords 27, 28.

FIGS. 24A through 24D are cross-sectional views of the retaining device 100 of the present invention showing the first receptacle 1 and second receptacle 2. FIGS. 24A–24D illustrate that the couplers 40, 50 can be oriented any desired position from 0° to 360°. Therefore, couplers 40, 50 of varying cross-sectional widths can be accommodated within the inner chambers 120 and 220 of the first and second receptacles 1, 2, respectively due to the free space available in the vicinity of the aligned openings 116, 216.

The first receptacle 1 and the second receptacle 2 are preferably molded from resilient non-conductive materials such as polyvinyl chloride, and flame retardant versions of polycarbonate, polybutyl terephthalate and others, as known to those skilled in the art.

The retaining device 100 minimizes catching the edges of objects while pulling the power/extension cord around the workplace. The generally conical shape of end pieces 112, 212, with their slanted fins 23 and 24, as shown in FIGS. 5 and 6, allow the device to ride generally unimpeded over the edges of furniture and other such obstructions. This tapered geometry at both ends of the disclosed device addresses the problem of catching the edges of objects while pulling the power/extension cord around the workplace.

The geometry of the retention device 100 provides convenience for the user. The user aligns the openings 116, 216 of the device with the mated plug 50 and socket 40 of the power cords 27 and 28 and pushes the mated plug and socket into the inner chamber of the device. The cords exiting from each end are snapped past the retaining protrusions 25, 26 and are held in place thereby. The two receptacles 1, 2 are then pushed together axially until the motion limiting members engage or nearly engage the end surfaces 42, 52 of the coupled socket and plug. The tabs 124, 126 are received by one of the slots 6, 10 to lock the receptacles 1, 2 in place to secure the plug and socket within the chamber of the retaining device. To unlock the retaining device in order to remove the coupled ends of the power cords, the user simply partially rotates one receptacle with respect to the other. This movement causes the tabs 124, 126 to escape sideways from slots 6, 10 in which they are received. Then, the receptacles 1, 2 may be pulled apart slightly so that the motion limiting members 114, 214 are no longer in engagement or near engagement with the end surfaces 42, 52 of the coupled socket 40 and plug 50. The socket 40 and plug 50 of the interconnected power cords may now be removed from the retaining device 100 through the openings 116 and 216.

It is envisioned to be within the scope of the present invention that the retaining device may be used to hold together the ends of other coupled objects, such as rope or wire.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A retaining device for retaining in a joined state a socket and a plug of a pair of electrical power cords, the retaining device comprising:

a first cylindrically walled receptacle having a first open end and a second open end, a motion limiting member disposed therebetween, and an opening extending from the first open end through the motion limiting member to the second open end of the first receptacle; and a second cylindrically walled receptacle having a first open end and a second open end, a motion limiting member disposed therebetween, and an opening extending from the first open end through the motion limiting member to the second open end of the second receptacle;

the first open end, the second open end and the opening extending from the first open end to the second open end of each of the first receptacle and second receptacle together forming a space for receiving at least the socket and plug of the pair of electrical power cords between the motion limiting members of the first and second receptacles, the motion limiting members limiting motion of the socket and plug of the pair of electrical power cords, one of the first receptacle and the second receptacle having a plurality of linearly arranged slots formed within the cylindrical wall thereof, each slot having a plurality of edges, the other of the first receptacle and the second receptacle having a resilient locking tab formed within the cylindrical wall thereof, the locking tab lockingly engaging with one of the linearly arranged slots by relative linear motion between the first receptacle and the second receptacle, the locking tab having a sloped surface, the locking tab disengaging with the one of the linearly arranged slots by relative rotation of the first and second receptacles such that the sloped surface of the locking tab moves under the one of the plurality of edges of the one of the linearly arranged slots to unlockingly disengage the first receptacle from the second receptacle, one of the first receptacle and the second receptacle having a motion limiting slot formed within the cylindrical wall thereof, the motion limiting slot bounded by a plurality of edges, the other one of the first receptacle and the second receptacle having a motion limiting tab formed within the cylindrical wall thereof, the motion limiting tab movably disposed within the motion limiting slot such that at least one of the plurality of edges of the motion limiting slot limits at least one of linear and rotational motion of the one of the first receptacle and the second receptacle with respect to the other of the first receptacle and the second receptacle.

2. A retaining device for retaining together a coupled plug and socket of a pair of electrical power cords, which comprises:

a telescopically expandable and retractable central portion having opposite first and second axial ends, the central portion having at least partially overlapping side walls which together define an interior space for receiving the coupled plug and socket; and a first plurality of radially extending, circumferentially-spaced fins and a second plurality of radially extending, circumferentially-spaced fins, the first plurality of radially extending, circumferentially-spaced fins being situated on the first axial end of the central portion and extending therefrom, and the second plurality of radially extending fins being situated on the second axial end of the central portion and extending therefrom, the fins of the first plurality of radially extending fins converging from a larger diameter proximate to the first axis end of the central portion to a first smaller diameter location distal from the first axial end of the central portion to thereby at least partially define a conically-shaped first end piece having formed therein a cord receiving opening at the first smaller diameter location distal from the first axial portion, the fins of the second plurality of radially extending fins converging from a larger diameter proximate to the second axial end of the central portion to a second smaller diameter location distal from the second axial end of the central portion to thereby at least partially define a conically-shaped second end piece having formed therein cord receiving opening at the second smaller diameter location distal from the second axial end of the central portion.

* * * * *